US007490503B1

(12) United States Patent
Kanemitsu et al.

(10) Patent No.: US 7,490,503 B1
(45) Date of Patent: Feb. 17, 2009

(54) METHOD OF PRODUCING A ROTARY MEMBER MADE OF A METALLIC PLATE

(75) Inventors: Toshiaki Kanemitsu, Kobe (JP); Kazuyuki Oda, Hyogo (JP)

(73) Assignee: Kanemitsu Corporation, Ookurahonmachi Akashi-shi, Hyogo (JP)

( * ) Notice: Subject to any disclaimer, the term of this patent is extended or adjusted under 35 U.S.C. 154(b) by 880 days.

(21) Appl. No.: 09/638,032

(22) Filed: Aug. 15, 2000

Related U.S. Application Data

(63) Continuation of application No. 08/841,108, filed on Apr. 30, 1997, now abandoned, which is a continuation of application No. 08/146,005, filed as application No. PCT/JP92/00508 on Apr. 20, 1992, now abandoned.

(51) Int. Cl.
*B21D 22/30* (2006.01)
*B21D 53/26* (2006.01)

(52) U.S. Cl. ..... 72/379.2; 72/348; 72/355.6; 72/356

(58) Field of Classification Search ..... 72/336, 72/348, 355.6, 356, 379.2
See application file for complete search history.

(56) References Cited

U.S. PATENT DOCUMENTS 4,899,569 A * 2/1990 Matsushita et al. ..... 72/336
5,119,664 A * 6/1992 Schubert ..... 72/356

FOREIGN PATENT DOCUMENTS

| | | | | |
|---|---|---|---|---|
| DE | 304482 | * 11/1916 | ..... | 72/343 |
| FR | 989543 | * 9/1951 | ..... | 72/356 |
| JP | 5768238 | 4/1982 | | |
| JP | 1218729 | 8/1989 | | |
| JP | 3180219 | 8/1991 | | |

* cited by examiner

*Primary Examiner*—Dmitry Suhol
(74) *Attorney, Agent, or Firm*—Bacon & Thomas, PLLC

(57) ABSTRACT

The method according to the present invention comprises: a first curving step of curving a plate-like metallic blank (1) such that the blank (1) is convexed; a bending step of bending, with the outer peripheral edge portion (1*e*) of the blank (1) restrained from radially outwardly extending, the resulting arcuate portion (1*b*) of the curved blank (1) in the direction opposite to the convex direction thereof, so that a boss (6) is formed; and a second curving step of pushing the inner peripheral portion of a flat portion (5) of the blank (1) in the direction opposite to the boss projecting direction. Through the steps above-mentioned, the blank (1) is provided at the center thereof with the case-like boss (6) projecting in one direction from one lateral side of the blank (1) and at the outer periphery thereof with a peripheral wall (7) projecting in the same direction in which the boss (6) projects. Thus, with a small press machine, there can be securely formed, with high precision, a boss having a desired diameter and a desired projecting height, without the original thickness of the blank (1) decreased so much in the course of production steps.

6 Claims, 4 Drawing Sheets

METHOD OF PRODUCING A ROTARY MEMBER MADE OF A METALLIC PLATE

This patent application is a continuation of U.S. patent application Ser. No. 08/841,108, filed Apr. 30, 1997, now abandoned, which is a further continuation of U.S. patent application Ser. No. 08/146,005, filed Nov. 4, 1993, now abandoned, which is a national stage entry of PCT/JP92/00508 filed Apr. 20, 1992.

TECHNICAL FIELD

The present invention relates to a method of producing a rotary member made of a metallic plate to be used as an inner wheel of a V-pulley, a rotor of an electromagnetic clutch or the like, such a rotary member being obtained by (i) integrally forming, at the center of a plate-like metallic blank, a case-like boss adapted to be put on a rotary body such as a rotary shaft, the case-like boss projecting in one direction from one lateral side of the blank, and (ii) integrally forming, at the outer periphery of the plate-like metallic blank, a case-like peripheral wall concentrically projecting in the same direction in which the boss projects. Also, the present invention relates to a method of producing a rotary member made of a metallic plate such as an unfinished intermediate part of a V-pulley or poly-V pulley made of a metallic plate, such a rotary member being obtained by integrally forming, at the center of a plate-like metallic blank, only a case-like boss adapted to be put on a rotary body such as a rotary shaft, the case-like boss projecting in one direction from one lateral side of the blank.

BACKGROUND ART

Conventionally, a cold forging method is widely used as a method of producing a predetermined rotary member by forming, at the center of a plate-like metallic blank, only a case-like boss projecting from one lateral side of the blank, or as a method of producing a predetermined rotary member by forming, at the center of a plate-like metallic blank, a case-like boss projecting in one direction from one lateral side of the blank, and by forming, at the outer periphery of the blank, a case-like peripheral wall concentrically projecting in the same direction in which the boss projects.

The conventional cold forging method above-mentioned is adapted to form only a case-like boss, or both a case-like boss and a case-like peripheral wall with the use of a plastic flow of a material itself. There is a sheet metal product such as a rotor of an electromagnetic clutch or a V-pulley requiring a boss having a relatively small inner diameter and a relatively great projecting height, or a sheet metal product requiring a relatively narrow annular space between a boss and a peripheral wall which are concentrically formed at inner and outer portions of the product. When producing such a sheet metal product from a thick blank in order to assure a sufficient strength, it is difficult to form such a boss having a predetermined diameter and a predetermined projecting height, or to form such a narrow annular space, even though there is used a large-size press machine of the class of 2,000 tons to 2,500 tons. Accordingly, the range in which such a product can be formed, is automatically limited by the relationship between the sizes of diameter, height and the like, and the thickness of the blank.

In view of the foregoing, the present invention is proposed with the object of providing a method of producing a rotary member made of a metallic plate, capable of forming, with high precision, only a boss or both a boss and a peripheral wall each having a predetermined diameter, a predetermined thickness and a predetermined height, with the use of a small press machine without the thickness of the initial material reduced so much in the course of production steps.

DISCLOSURE OF THE INVENTION

To achieve the object above-mentioned, the present invention provides a method of producing a rotary member made of a metallic plate, by which there is formed, at the center of a plate-like metallic blank, a case-like boss which projects in one direction from one lateral side of the blank, and this method comprises the steps of: curving a metallic blank such that the blank is convexed in the direction in which a boss is adapted to project; and bending, with the outer peripheral edge portion of the curved blank restrained from radially outwardly extending, the resulting arcuate portion of the blank in the direction opposite to the convex direction thereof, so that a case-like boss having a bottom and an annular flat portion are formed.

According to the method of producing a rotary member made of a metallic plate of the present invention, both the curving step of curving a metallic blank for forming a case-like boss and the bending step of bending the resulting arcuate portion of the blank, are a kind of bending operations. This restrains the blank from being reduced in thickness due to a plastic flow of the blank material, thus restraining the strength from being lowered. Further, even though the metallic blank is considerably thick, a predetermined boss can be readily formed with the use of a relatively small-size press machine. Further, at the bending step, the outer peripheral edge portion of the blank is restrained from radially outwardly extending. This prevents the blank material from being outwardly moved, but causes the blank material to be moved toward the center of the blank. Accordingly, there can be formed a boss having a sufficient thickness and a predetermined projecting height, even though the boss has a small inner diameter.

The present invention also provides a method of producing a rotary member made of a metallic plate, by which a plate-like metallic blank is processed such that the blank is provided at the center thereof with a case-like boss projecting in one direction from one lateral side of the blank, and at the outer periphery thereof with a case-like peripheral wall concentrically projecting in the same direction in which the case-like boss projects, and this method comprises; a first curving step of curving a metallic blank such that the blank is convexed in the direction in which a boss is adapted to project; a bending step of bending, with the outer peripheral edge portion of the curved blank restrained from radially outwardly extending, the resulting arcuate portion of the curved blank in the direction opposite to the convex direction thereof, so that a case-like boss having a bottom and an annular flat portion are formed; and a second curving step of pushing, with the case-like boss having the bottom restrained from being deformed, the inner peripheral portion of the annular flat portion in the direction opposite to the direction in which the case-like boss projects, so that a case-like peripheral wall is formed, as upwardly standing, at the outer periphery of the flat portion.

According to the method of producing a rotary member made of a metallic plate of the present invention, all the first curving step of curving a metallic blank for forming a case-like boss, the bending step of bending the resulting arcuate portion of the blank and the second curving step of pushing the flat portion to form a case-like peripheral wall, are a kind of bending operations. This restrains the blank from being reduced in thickness due to a plastic flow of the blank material, thus restraining the strength from being lowered. Further, even though the metallic blank is considerably thick, a predetermined boss and a pre-determined peripheral wall can be readily formed with the use of a relatively small-size press machine. Further, at the bending step, the outer peripheral edge portion of the blank is restrained from radially outwardly extending. This prevents the blank material from being outwardly moved, but causes the blank material to be moved toward the center of the blank. Accordingly, there can be formed a boss having a sufficient thickness and a predetermined projecting height, even though the boss has a small inner diameter. Further, at the second curving step, the boss formed at the bending step is restrained from being deformed. This prevents the blank material from being moved both inwardly and outwardly. Thus, the boss can be prevented from being deformed, and the peripheral wall having a sufficient thickness can be formed. Further, the outer peripheral edge of the blank is restrained from radially outwardly extending, and the boss is restrained from being deformed. This improves the dimensional precision of the resulting product in its entirety.

The method according to the present invention may further comprise, after the bending step, a finishing step of axially compressing the bottom of the case-like boss formed at the bending step such that the bottom becomes flat and is located at a predetermined projecting height. In such an arrangement, the boss having a predetermined projecting height can be finished with higher precision. Further, a boss portion which projects excessively in the height direction, can be axially compressed to cause the boss to be thickened. This is more advantageous in view of the strength of the boss.

The method according to the present invention may further comprise, after the second curving step, a cutting step of cutting the projecting end portion of the case-like boss having the bottom formed at the bending step, thus forming a shaft insertion hole in the case-like boss. In such an arrangement, even though there occur errors about dimensional precision at the curving and/or bending steps, such errors can be absorbed, thus ultimately providing a rotary member of which dimensional precision is very high.

BEST MODE FOR CARRYING OUT THE INVENTION

The following description will discuss a method of producing a rotary member made of a metallic plate according to an embodiment of the present invention, in the form of a method of producing a rotor to be used as assembled in an electromagnetic clutch. In this embodiment, using a circular plate-like metallic blank having a thickness t of about 3 to about 5, there is formed a rotor for an electromagnetic clutch having (i) a boss of which inner diameter d1 is about 60 mm and of which projecting height h is in the range from about 28 to about 32 mm, and (ii) a peripheral wall of which outer diameter d2 is in the range from about 120 to about 150 mm.

Figure 1A:
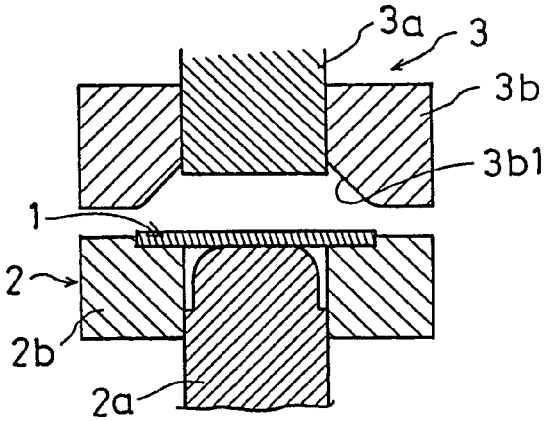
FIG. 1A and FIG. 1B are section views of main portions of a first sub-step of a first curving (drawing) step in a method of producing a rotary member made of a metallic plate according to an embodiment of the present invention.
Figure 1B:
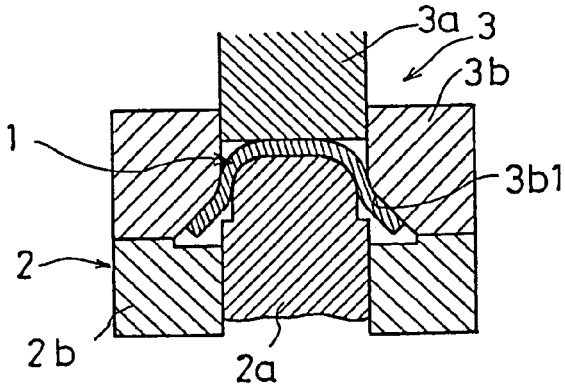

FIG. 1A shows a first sub-step of a first curving (drawing) step. As shown in FIG. 1A, a circular flat metallic blank 1 is set on a lower mold 2 having a punch 2*a* and a punch holder 2*b*, and a press machine (not shown) is operated such that the lower mold 2 and an upper mold 3 having a die 3*a* and a die holder 3*b* approach to each other. As shown in FIG. 1B, the metallic blank 1 is then drawn in its entirety in the boss projecting direction such that the metallic blank 1 is convexly curved in two stages. The shape in which the metallic blank 1 is curved, is determined by the tip shape of the punch 2*a* of the lower mold 2 and an inlet tapering surface 3*b*1 of the die holder 3*b* of the upper mold 3.

Figure 2A:
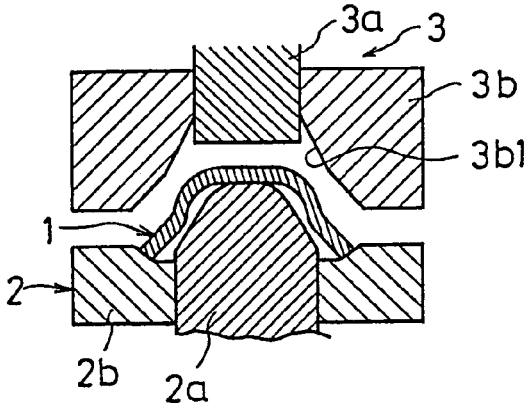
FIG. 2A and FIG. 2B are section views of main portions of a second sub-step of the first curving (drawing) step in the method above-mentioned.
Figure 2B:
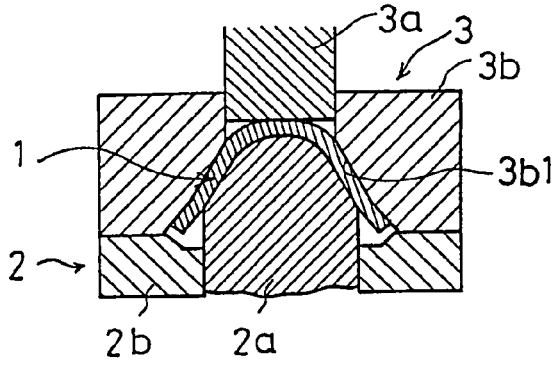
Figure 3A:
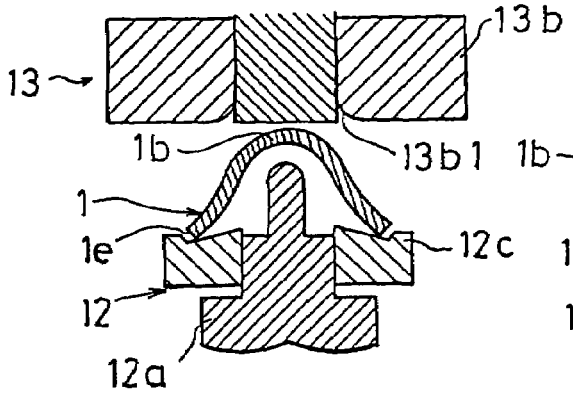
FIG. 3A and FIG. 3B are section views of main portions of a first bending (squeezing) step in the method above-mentioned.
Figure 3B:
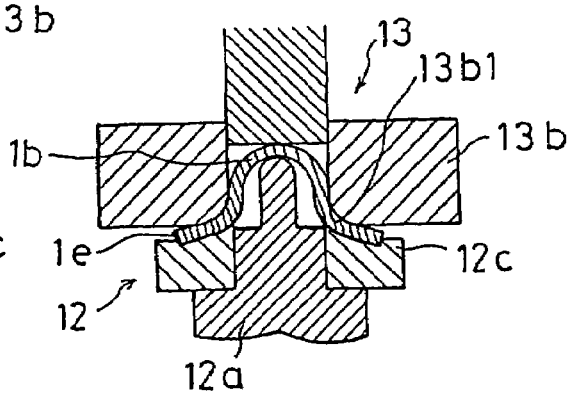
Figure 4A:
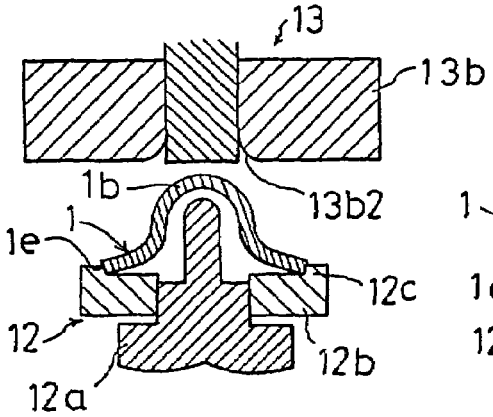
FIG. 4A and FIG. 4B are section views of main portions of a second bending (squeezing) step in the method above-mentioned.
Figure 4B:
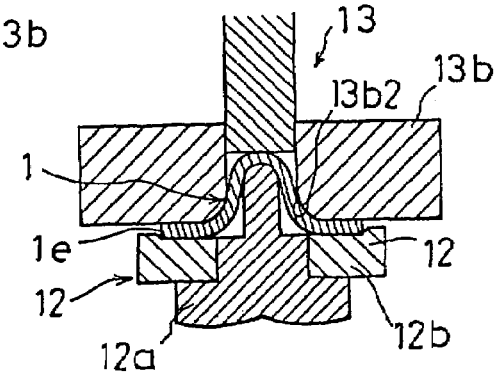
Figure 5A:
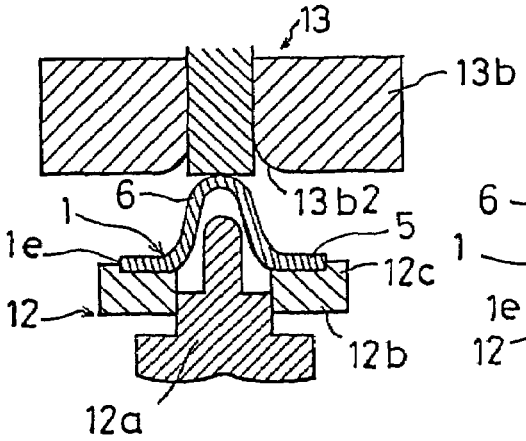
FIG. 5A and FIG. 5B are section views of main portions of a third bending (squeezing) step in the method above-mentioned.
Figure 5B:
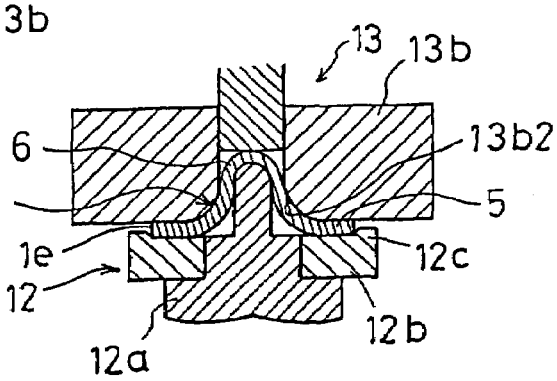

As shown in FIG. 2A and FIG. 2B in which a second sub-step of the first curving (drawing) step is shown, there are used (i) a punch 2*a* of which tip shape is different from that of the punch 2*a* used in the first sub-step, and (ii) a die holder 3*b* of which inlet tapering surface 3*b*1 is different from that of the die holder 3*b* used in the first sub-step. Likewise in the first sub-step, the press machine is operated such that an upper mold 3 and a lower mold 2 approach to each other, thus drawing the metallic blank 1 substantially in the form of a cone.

Then, the sequence proceeds to bending (squeezing) steps for forming a case-like boss. As shown in FIG. 3A, FIG. 3B to FIG. 6A, FIG. 6B, the bending (squeezing) steps include first to fourth steps. In each of these first to fourth bending steps, there are used dedicated lower and upper squeezing molds 12, 13 which are different from those used at the first curving (drawing) step in the projecting amount and tip curvature of a punch 12*a* of each lower mold 12 and in the curvature of the inlet corner portion 13*b*2 of a die holder 13*b* of each upper mold 13. In the bending (squeezing) steps, the upper and lower molds 13, 12 are caused to approach to each other so that an arcuate portion 1*b* of the blank 1 is squeezed and bent in the direction opposite to the convex direction thereof. As a result, the arcuate portion 1*b* is deformed along the outer peripheral surface of each punch 12*a*, thus forming (i) a case-like boss 6 having a bottom at the center of the blank 1 and (ii) an annular flat portion 5 at the outer periphery of the case-like boss 6.

Figure 6A:
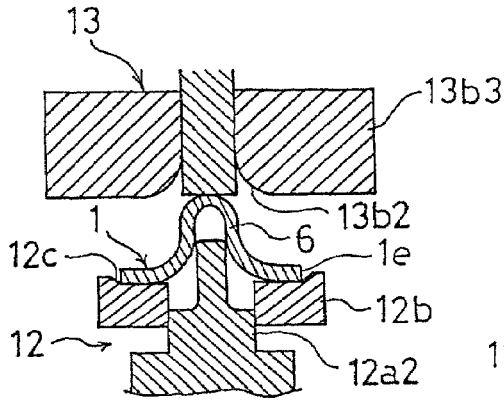
FIG. 6A and FIG. 6B are section views of main portions of a fourth bending (squeezing) step in the method above-mentioned.
Figure 6B:
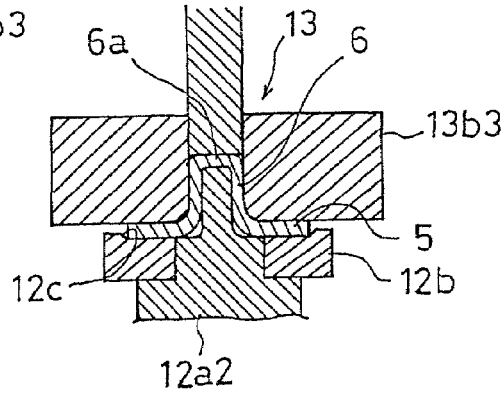

At the fourth bending step shown in FIG. 6A and FIG. 6B, out of the plurality of bending steps, a boss finishing process is carried out. More specifically, with the use of a dedicated finishing punch 12*a*2 and a dedicated finishing die holder 13*b*2, the bottom 6*a* of the case-like boss 6 is axially compressed such that the bottom 6*a* of the case-like boss 6 becomes flat and is located at a predetermined height.

In each of the plurality of bending steps, an outer peripheral edge portion 1*e* of the blank 1 comes in contact with the inner surface of an annular projection 12*c* of the punch holder 12*b* of each lower mold 12. Accordingly, the outer peripheral edge portion 1*e* is always restrained from radially outwardly extending. This perfectly prevents the material of the blank 1 from flowing in the radially outward direction, but causes the material of the blank 1 to flow toward the case-like boss 6. Accordingly, the case-like boss 6 can be securely thickened and the linear portion of the case-like boss 6 can be securely lengthened.

Figure 7A:
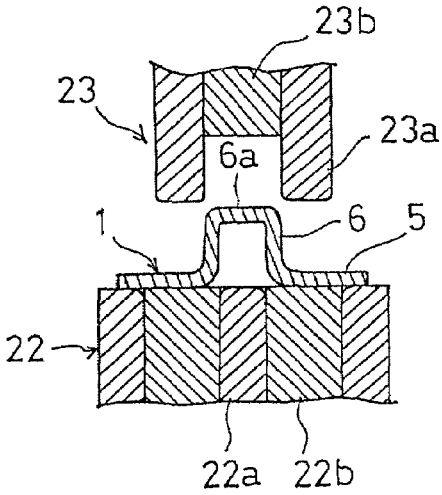
FIG. 7A and FIG. 7B are section views of main portions of a second curving (drawing) step in the method above-mentioned.
Figure 7B:
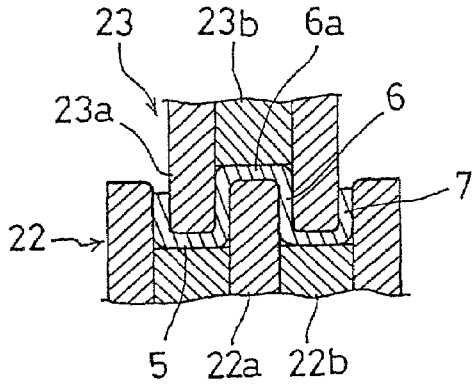

Then, the sequence proceeds to a second curving (drawing) step for forming, at the outer periphery of the blank 1, a peripheral wall concentric with the case-like boss 6. At the second curving (drawing) step in FIG. 7A, the blank 1 having the case-like boss 6 and the annular flat portion 5 is set on a lower mold 22 having (i) a center projecting portion 22*a* which has an outer diameter substantially equal to the inner diameter of the case-like boss 6 and of which top surface is flat, and (ii) an annular movable portion 22*b* slidably fitted to and held by the center projecting portion 22*a*. An upper mold 23 has a case-like projecting portion 23*a* of which inner diameter substantially equal to the outer diameter of the case-like boss 6 and of which thickness is equal to about a half of the radial distance of the annular flat portion 5. The upper mold 23 also has a column portion 23*b* fitted in and secured to the case-like projecting portion 23*a* such that the tip surface of the column portion 23*b* is located in a position which is depressed, from the tip of the case-like projecting portion 23*a*, by a distance corresponding to the projecting height of the case-like boss 6. The press machine is operated such that the upper mold 23 and the lower mold 22 approach to each other. Accordingly, as shown in FIG. 7B, while the center projecting portion 22*a* of the lower mold 22 is moved as coming in close contact with the inside of the case-like boss 6 to restrain the deformation of the case-like boss 6, the inner peripheral portion of the annular flat portion 5 is pushed down in the direction opposite to the direction in which the boss 6 project, and a case-like peripheral wall 7 is formed, at the outer periphery of the annular flat portion 5, as standing and projecting in the same direction in which the boss 6 projects. In this second curving (drawing) step, the case-like boss 6 is restrained from being deformed because the center projecting portion 22*a* of the lower mold 22 is fittingly moved inside of the case-like boss 6. This prevents the material of the blank 1 from flowing in both inward and outward directions. This not only prevents the boss 6 from being deformed, but also enables the peripheral wall 7 to be made sufficiently thick.

Figure 8A:
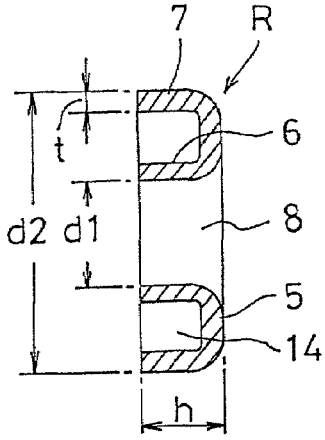
FIG. 8A and FIG. 8B are a vertical section view and a plan view of a rotary member made of a metallic plate produced by the method of the present invention.

After completion of the steps above-mentioned, the projecting end portion including the bottom 6*a* of the case-like boss 6, is cut such that the projecting end portion has a predetermined projecting height h, thus forming a shaft insertion hole 8 in the boss 6. Accordingly, as shown in FIG. 8A and FIG. 8B, there is produced a rotor R for an electromagnetic clutch having the sizes above-mentioned.

Figure 9:
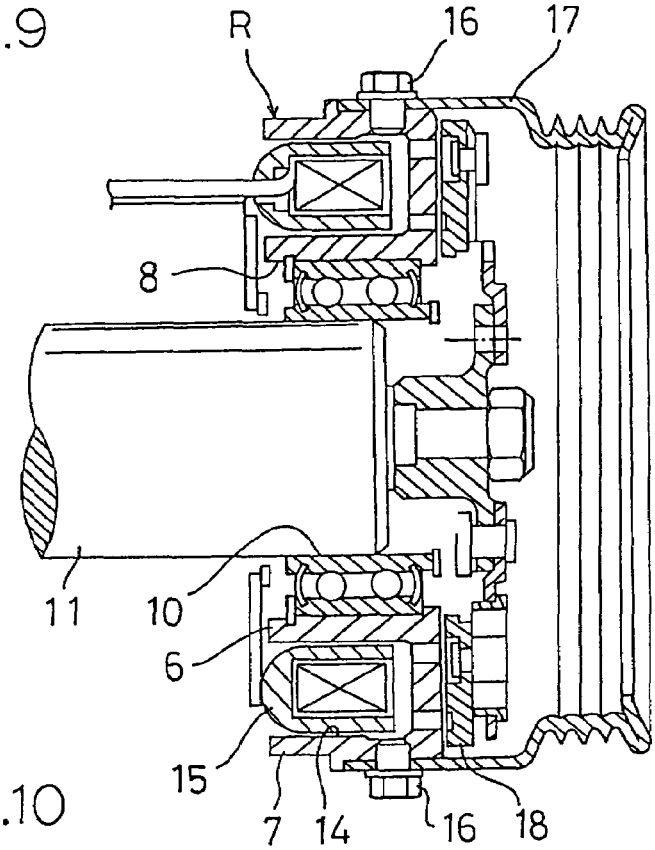
FIG. 9 is a vertical section view of a rotary member made of a metallic plate produced by the method of the present invention, as assembled as a rotor of an electromagnetic clutch.

The rotor R thus produced is so used as to form a predetermined electromagnetic clutch. More specifically, as shown in FIG. 9, a rotary shaft 11 is rotatably inserted and fitted, through a bearing 10, in the shaft insertion hole 8 formed in the case-like boss 6 at the center thereof, and a core 15 for an electromagnetic clutch is assembled in an annular space 14 which is formed between the boss 6 and the peripheral wall 7 and which is opened in one direction. A rotation transmitting wheel 17 such as a poly-V pulley is securely connected to the outer periphery of the peripheral wall 7 through bolts 16. An armature 18 or the like integrally rotatable with the rotary shaft 11 is disposed at the outer-surface side of the flat portion 5 of the rotor R.

Figure 8B:
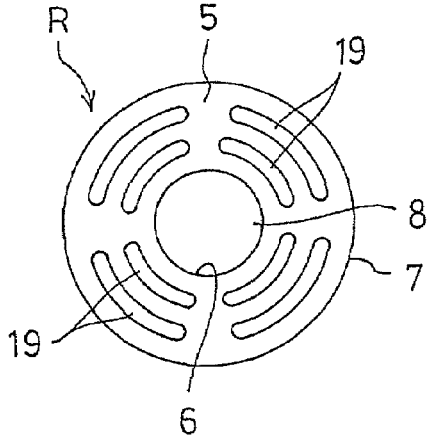

When using the rotary member of the present invention as the rotor for an electromagnetic clutch above-mentioned, it is preferable to form arcuate heat radiating holes 19 in the flat portion 5, as shown in FIG. 8B. Such holes 19 increase heat radiation from the annular space 14 in which the core 15 is to be incorporated.

Figure 10:
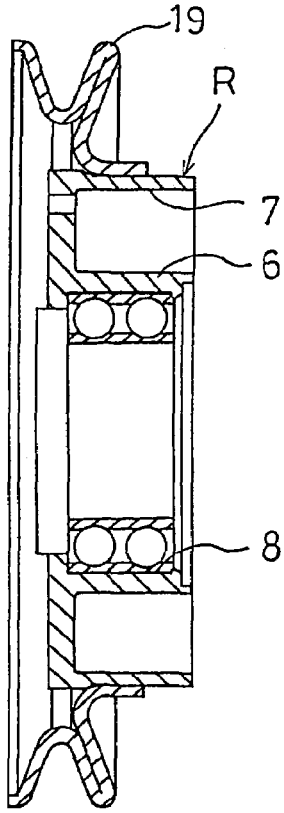
FIG. 10 is a vertical section view of a rotary member made of a metallic plate produced by the method of the present invention, as assembled as an inner wheel of a V-pulley.

In the embodiment above-mentioned, the description has been made of the method of producing a rotary member made of a metallic plate adapted to be used as a rotor for an electromagnetic clutch. However, a product to be produced by the method, of the present invention is not limited to such a rotor. For example, the method of the present invention may be applied for production of a rotary member to be used as an inner wheel of a V-pulley 19 as shown in FIG. 10.

Figure 11:
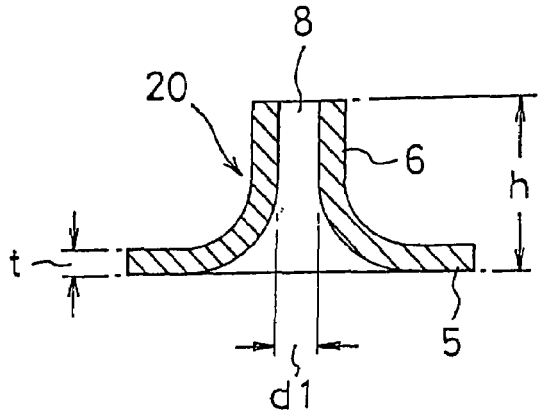
FIG. 11 is a vertical section view of a product produced by the method of producing a rotary member made of a metallic plate according to another embodiment of the present invention.

FIG. 11 is a vertical section view of an unfinished intermediate part 20 of a V-pulley or poly-V pulley made of a metallic plate produced by the method of the present invention. This unfinished intermediate part 20 may be produced through steps similar to those shown in FIGS. 1A, 1B to FIGS. 6A, 6B. More specifically, a blank is so processed as to be provided at the center thereof with a case-like boss 6 having a bottom and at the outer periphery thereof with a flat portion 5. Then, the projecting end portion including the bottom (at the upper end side in FIG. 11) of the case-like boss 6, is cut such that the projecting end portion has a predetermined projecting height h, or the bottom (at the upper end side in FIG. 11) of the case-like boss 6 is punched, thus forming a shaft insertion hole 8 in the case-like boss 6 at the center thereof.

INDUSTRIAL APPLICABILITY

The method of producing a rotary member made of a metallic plate of the present invention, is technology of integrally forming, at the center of a plate-like metallic blank, only a case-like boss which projects in one direction from one lateral side of the blank, or integrally forming both such a case-like boss and a case-like peripheral wall at the outer periphery of the plate-like metallic blank, the peripheral wall concentrically projecting in the same direction in which the case-like boss projects. More specifically, with the use of a small press machine, there can be securely formed, with high precision, only a boss or both a boss and a peripheral wall, each of which has a desired diameter, a desired thickness and a desired projecting height, such formation being made by combining kinds of bending operations so that the original thickness of the blank is not decreased so much in the course of production steps. This production technology can be effectively utilized for producing a rotor for an electromagnetic clutch, a V-pulley and the like.

What is claimed is:

1. In a method of producing a rotary member made of a metallic plate by which there is formed, at the center of a plate-like metallic blank, a case-like boss which projects in one direction from the lateral side of the blank, said method comprising the steps of:

curving a plate-like metallic blank such that said blank is convex in the direction in which a boss is adapted to project, has a resulting arcuate portion, and an outer peripheral edge portion as well; and restraining the outer peripheral edge portion of the curved blank from extending radially outwardly while bending said resulting arcuate portion of the curved metallic blank in the direction opposite to the convex direction using a plurality of molds to gradually reduce the boss, so that the boss is case-like having an annular flat portion, such that the boss and annular flat portion have substantially the same thickness.

2. In a method of producing a rotary member made of a metallic plate by which a plate-like metallic blank is processed such that the blank is provided at the center thereof with a case-like boss projecting in one direction from one lateral side of the blank, and at the outer periphery thereof with a case-like peripheral wall concentrically projecting in the same direction in which the case-like boss projects, said method comprising the steps of:

a first curving step of curving a plate-like metallic blank such that said blank is convex in the direction in which a boss is adapted to project, has a resulting arcuate portion, and an outer peripheral edge portion as well;

restraining the outer peripheral edge portion of said curved blank from extending radially outwardly, while bending said resulting arcuate portion of the curved metallic blank in the direction opposite to the convex direction using a plurality of molds to gradually reduce the boss, so that the boss is case-like having an annular flat portion; and a second curving step of pushing, with the case-like boss having the bottom restrained from being deformed, the inner peripheral portion of the annular flat portion in the direction in which said case-like boss projects, so that a case-like peripheral wall is formed, such that the boss, annular flat portion and said case-like peripheral wall have substantially the same thickness.

3. A method of producing a rotary member made of a metallic plate according to claim 2, further comprising the step of:

axially compressing the bottom of the case-like boss formed by said bending, such that said bottom becomes flat and is located at a predetermined projecting height.

4. A method of producing a rotary member made of a metallic plate according to claim 3, further comprising the step of;

cutting the projecting end portion of the case-like boss having the bottom formed at the bending step after said second curving step, thus forming a shaft insertion hole therein.

5. A method of producing a rotary member made of a metallic plate according to claim 2, further comprising the step of:

axially compressing the case-like boss having the bottom formed by said bending, such that said bottom becomes flat and is located at a predetermined projecting height.

6. A method of producing a rotary member made of a metallic plate according to claim 2, further comprising the step of:

cutting the projecting end portion of the case-like boss having the bottom formed at the bending step after said second curving step, thus forming a shaft insertion hole therein.

* * * * *